US006102740A

United States Patent [19]

Murakami et al.

[11] Patent Number: 6,102,740

[45] Date of Patent: Aug. 15, 2000

[54] WATERPROOF CONNECTOR AND ASSEMBLING METHOD OF WATERPROOF CONNECTOR

[75] Inventors: Takao Murakami; Masaru Fukuda, both of Shizuoka-ken, Japan

[73] Assignee: Yazaki Corporation, Tokyo, Japan

[21] Appl. No.: 09/265,387

[22] Filed: Mar. 10, 1999

[30] Foreign Application Priority Data

Mar. 11, 1998 [JP] Japan ..... 10-60099

[51] Int. Cl.[7] ..... H01R 13/40

[52] U.S. Cl. ..... 439/598; 439/271; 439/587

[58] Field of Search ..... 439/598, 589, 439/586, 597, 587, 190, 271

[56] References Cited

U.S. PATENT DOCUMENTS

| | | | |
|---|---|---|---|
| 5,116,236 | 5/1992 | Colleran et al. | 439/271 |
| 5,197,898 | 3/1993 | Nagamine | 439/271 |
| 5,197,899 | 3/1993 | Akeda | 439/271 |
| 5,222,909 | 6/1993 | Nomura et al. | 439/607 |
| 5,645,451 | 7/1997 | Ohsumi et al. | 439/587 |
| 5,720,629 | 2/1998 | Self, Jr. et al. | 439/587 |

FOREIGN PATENT DOCUMENTS

| | | | |
|---|---|---|---|
| 62-147277 | 9/1987 | Japan | H01R 13/52 |
| 5-65996 | 9/1993 | Japan | H01R 13/52 |
| 7-263076 | 10/1995 | Japan | H01R 13/52 |
| WO 9632760 | 10/1996 | WIPO | H01R 13/436 |
| WO 9736346 | 10/1997 | WIPO | H01R 13/52 |

OTHER PUBLICATIONS

European Search Report dated Oct. 4, 1999.

*Primary Examiner*—Renee Luebke
*Assistant Examiner*—Michael C. Zarroli
*Attorney, Agent, or Firm*—Finnegan, Henderson, Farabow, Garrett & Dunner, L.L.P.

[57] ABSTRACT

A waterproof connector includes an inner housing, an outer housing, a rubber plug and a spacer. The inner housing includes a plurality of terminal accommodation chambers, and a terminal is accommodated in each of the terminal accommodation chambers. The inner housing is fitted into the outer housing. The outer housing includes a first wall. The first wall includes a rubber plug accommodation recess which opens inside the outer housing, and a first insertion hold bringing the rubber plug accommodation recess and the outside into communication with each other. The rubber plug includes a third insertion hole, and is inserted in the rubber plug accommodation recess. The spacer is disposed between the inner housing and the outer housing for holding the terminals accommodated in the terminal accommodation chamber. The spacer includes a second wall between the terminal accommodation chamber and the first wall. The second wall includes a second insertion hole. The terminals in the terminal accommodation chambers are connected to electric wires. Each of the electric wires passes through the first, third and second insertion holes. The terminal accommodation chambers and the electric wires are sealed by the rubber plug.

9 Claims, 9 Drawing Sheets

WATERPROOF CONNECTOR AND ASSEMBLING METHOD OF WATERPROOF CONNECTOR

BACKGROUND OF THE INVENTION

The present invention relates to a small size multipolar waterproof connector having improved waterproof properties with respect to a plurality of electric wires connecting a housing and a terminal, and to an assembling method of the waterproof connector.

As a waterproof connector of this kind, there are connectors as disclosed in Japanese Patent No. H5-65996 shown in FIG. 8, Japanese Patent Application Laid-open No. H7-263076 shown in FIG. 9, and Japanese Utility Model Registration Application Laid-open No. S62-147277 shown in FIG. 10.

SUMMARY OF THE INVENTION

In the case of a waterproof connector 51 shown in FIG. 8, a terminal 55 in a terminal accommodation chamber 53 of a housing 52 engages a plastic engaging portion 56 integrally extending from the housing 52 and a hook portion 57*a* of a spacer 57 mounted to the housing 52. In order to prevent the terminal 55 from easily seperating from the terminal accommodation chamber 53 when the spacer 57 is mounted, it is necessary to increase the projecting amount of the plastic engaging portion 56 or the hook portion 57*a*. Since the increase of the projecting amount of the plastic engaging portion 56 brings about the increase of the inserting force of the terminal 55 into the terminal accommodation chamber 53, there is a possibility of deteriorating the inserting operation of the terminal 55. The increase of the projecting amount of the hook 57*a* brings about the increase of the mounting force of the spacer 57 to the housing 52.

In the case of a waterproof connector 61 or 71 shown in FIG. 9 or 10, a rubber plug cover 68 or a rear holder 78 prevents a rubber plug 69 or 79 from coming off from a housing 62 or 72. Therefore, the rubber plug cover 68 or the rear holder 78 which is a part used for only preventing the rubber plug from coming off is indispensable and thus, the number of parts is increased, the structure is complicated, and the cost is increased. Further, the rubber plug cover 68 or the rear holder 78 is held by the housing 62 or 72 due to engagement with the housing 62 or 72 only. Therefore, there is an unfavorable possibility that the rubber plug cover 68 or the rear holder 78 might come off of, or become seperated from the housing 62 or 72.

SUMMARY OF THE INVENTION

Thereupon, it is an object of the present invention to provide a waterproof connector and an assembling method of the waterproof connector in which the assembling operation efficiency, the holding force with respect to a terminal and the waterproof properties with respect to a rubber plug are enhanced, and the cost can be reduced by reducing the number of parts.

To achieve the above object, a waterproof connector of the present invention includes an inner housing, an outer housing, a rubber plug and a spacer. The inner housing includes a plurality of terminal accommodation chambers, and a terminal is accommodated in each of the terminal accommodation chambers. The inner housing is fitted into the outer housing. The outer housing includes a first wall. The first wall includes a rubber plug accommodation recess which opens inside the outer housing, and a first insertion hold bringing the rubber plug accommodation recess and the outside into communication with each other. The rubber plug includes a third insertion hole, and is inserted in the rubber plug accommodation recess. The spacer is disposed between the inner housing and the outer housing for holding the terminals accommodated in the terminal accommodation chamber. The spacer includes a second wall between the terminal accommodation chamber and the first wall. The second wall includes a second insertion hole. The terminals in the terminal accommodation chambers are connected to electric wires. Each of the electric wires passes through the first, third and second insertion holes. The terminal accommodation chambers and the electric wires are sealed by the rubber plug.

According to this waterproof connector, since the terminals are held by the spacer between the inner housing and the outer housing, the holding force of the terminals is increased, and the reliability is enhanced. Therefore, when the electric wires are pulled for example, the spacer prevents the terminals from moving and thus, the terminals are reliably held in the terminal accommodation chambers.

The spacer may include a projection for holding the terminals in the terminal accommodation chambers of the inner housing, and the second wall of the spacer may prevent the rubber plugs from coming off from the rubber plug accommodation recesses.

According to this structure, since the terminals and the rubber plug are held by the spacer, the part used for only preventing the rubber plug from coming off is unnecessary, and it is possible to simplify the structure, to reduce the number of parts, and to reduce the cost.

The outer housing may be provided with the first engaging portion, the spacer may be provided with a second engaging portion capable of engaging the first engaging portion, and a packing may be disposed between the outer housing and the spacer.

According to this structure, due to the engagement between the first engaging portion of the outer housing and the second engaging portion of the spacer, it is possible to prevent the packing from coming off from the waterproof connector. Therefore, the waterproof properties of the waterproof connector are further enhanced.

The inner housing may be provided with a third engaging portion capable of engaging the first engaging portion.

According to this structure, the spacer is held by the outer housing due to the engagement between the second engaging portion of the spacer and the first engaging portion of the outer housing, and due to the engagement between the third engaging portion of the inner housing and the first engaging portion of the outer housing. That is, since the spacer is double-engaged, the rubber plug is reliably prevented from coming off, and the waterproof reliability is further enhanced.

According to an assembling method of waterproof connector of the present invention, the rubber plug is first inserted into the rubber plug accommodation recess of the outer housing along a first direction. Secondary, the spacer is fitted into the outer housing along the first direction. Thirdly, the electric wires are sequentially inserted through a first insertion hole of the outer housing, a second insertion hole of the rubber plug, and a third insertion hole of the spacer. Fourthly, the electric wires are connected to the terminals in the terminal accommodation chambers of the inner housing. Lastly, the inner housing is fitted into the spacer along the first direction. According to this method, the terminal accommodation chambers and the electric wires are sealed by the rubber plug.

According to this method, a small size multipolar waterproof connector having excellent holding strength of the terminals and excellent waterproof properties can be assembled easily and at low cost.

DESCRIPTION OF THE PREFERRED EMBODIMENT

An embodiment of the present invention will be explained based on the drawings below.

Figure 1:
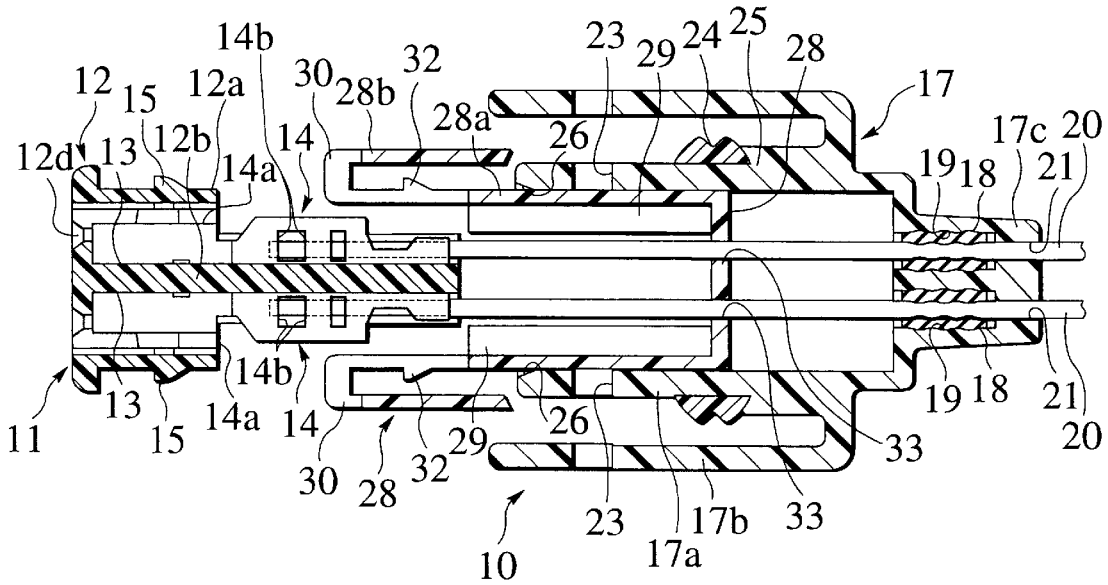
FIG. 1 is a sectional view showing a state before a waterproof connector of an embodiment of the present invention is assembled.
Figure 2:
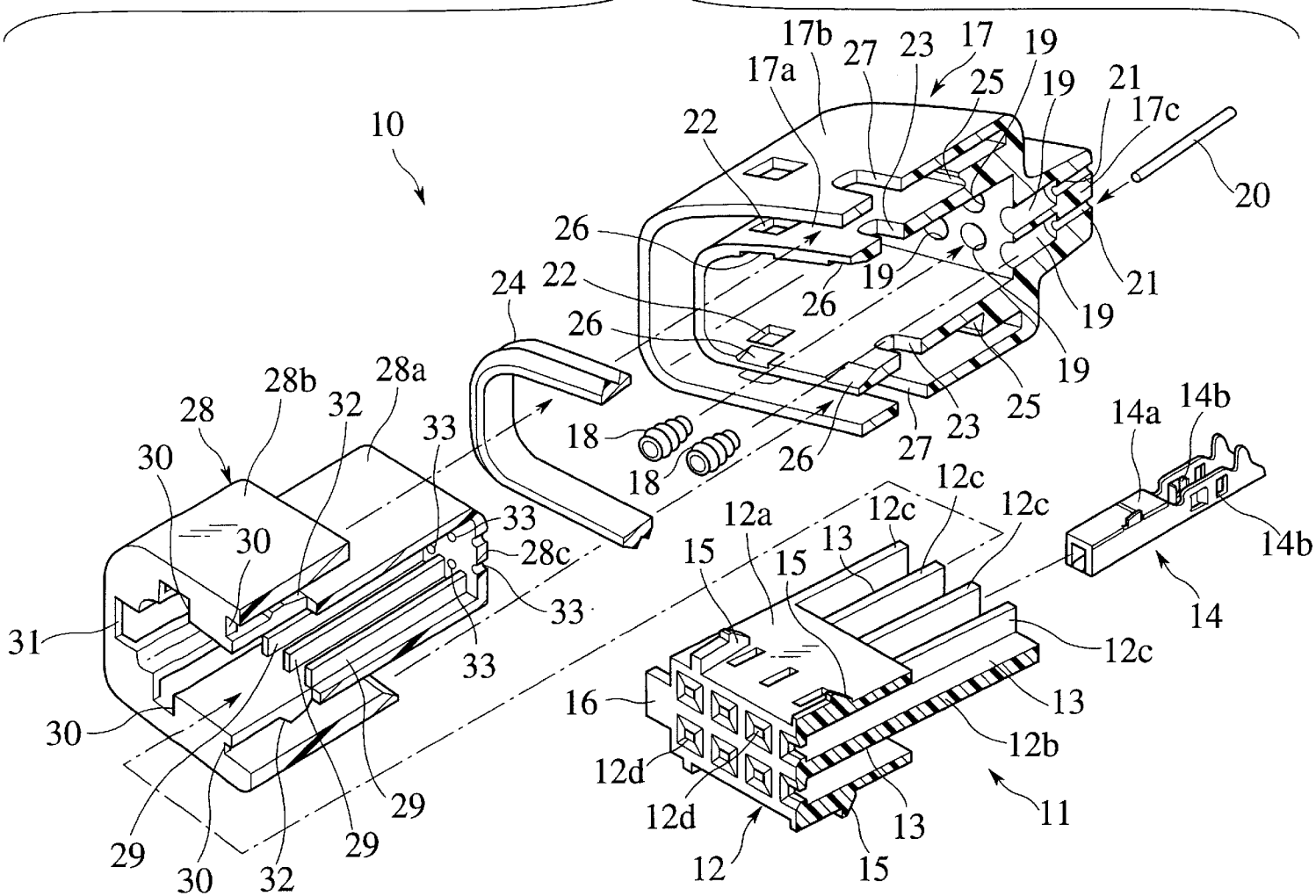
FIG. 2 is a partial sectional perspective view showing a state before the waterproof connector shown in FIG. 1 is assembled.
Figure 3:
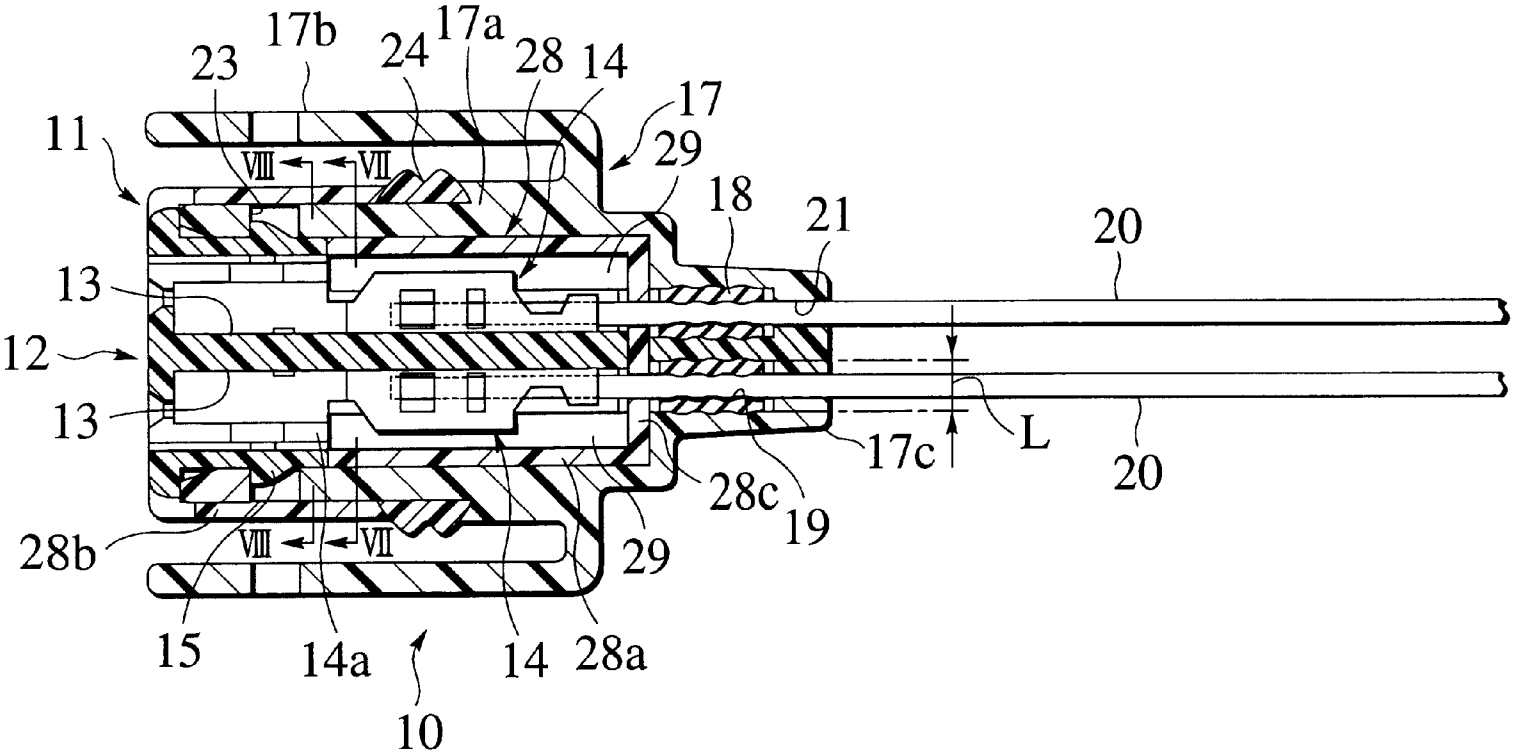
FIG. 3 is a sectional view showing a state in which the waterproof connector shown in FIG. 1 has been assembled.
Figure 4:
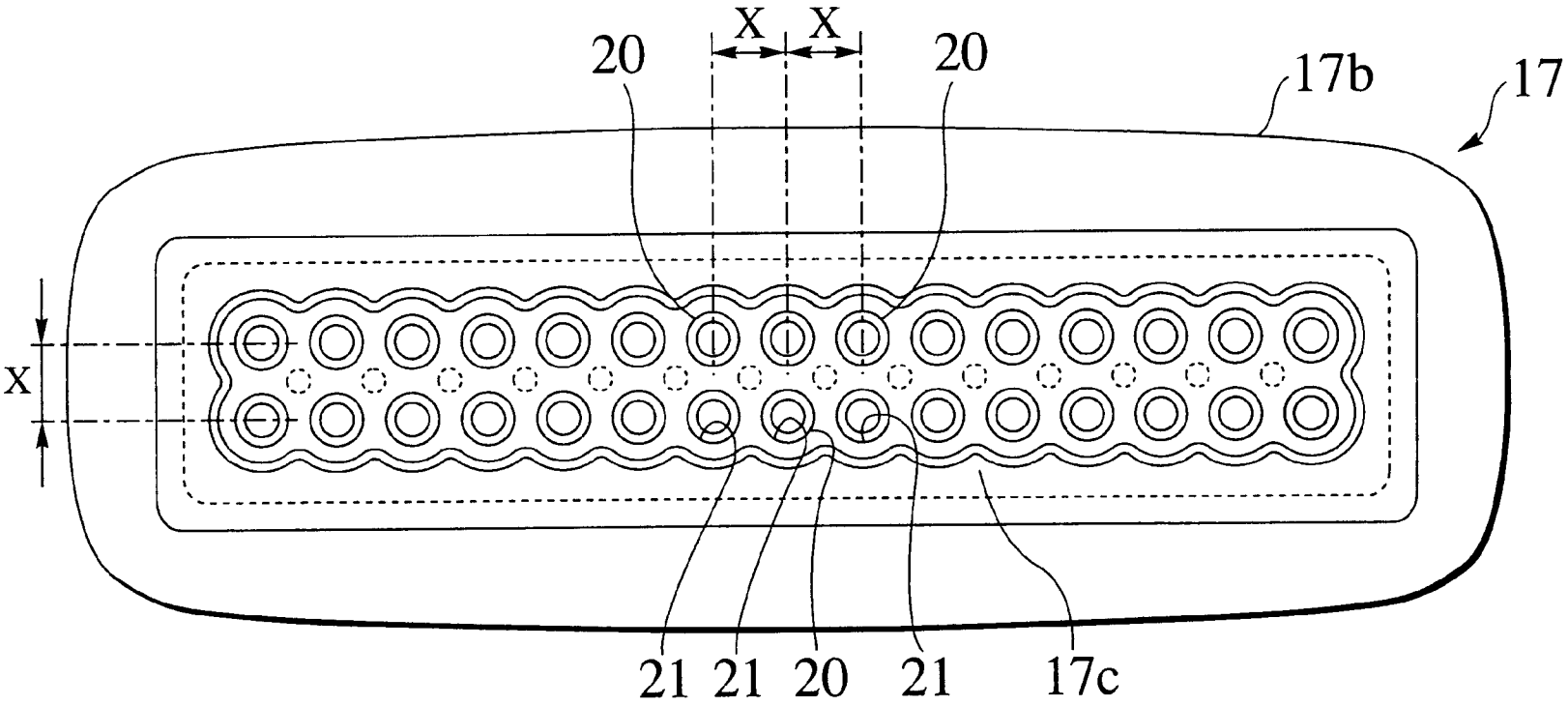
FIG. 4 is a rear elevation view of the waterproof connector shown in FIG. 1.
Figure 5:
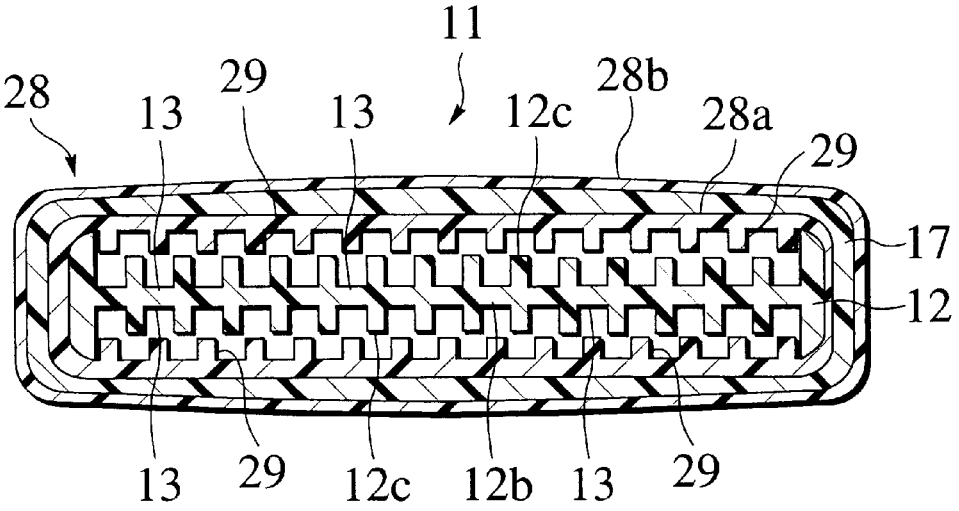
FIG. 5 is a sectional view taken along the line V—V in FIG.
Figure 6:
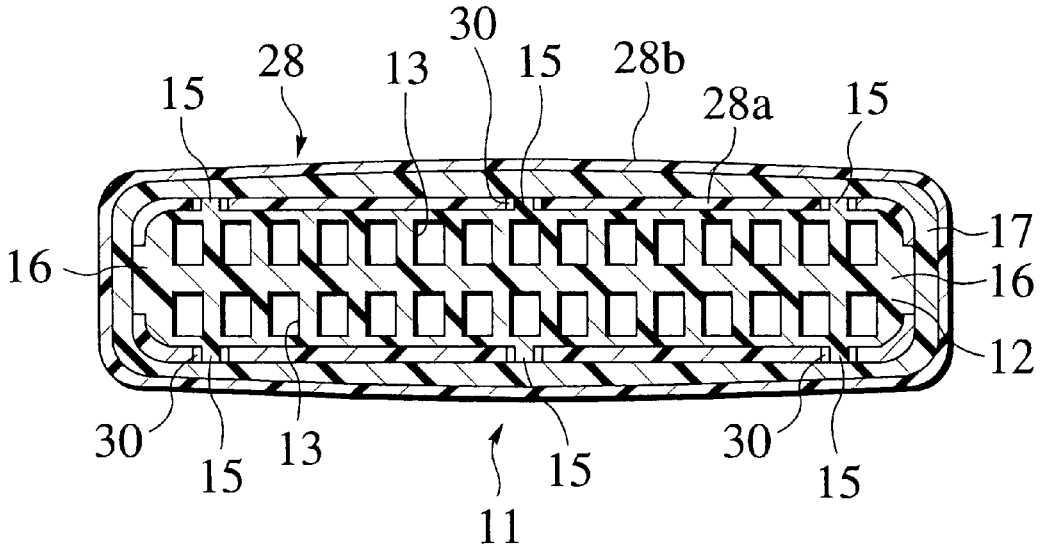
FIG. 6 is a sectional view taken along the line VI—VI in FIG. 3.

FIG. 1 is a sectional view showing a state before a waterproof connector of an embodiment of the present invention is assembled, FIG. 2 is a partial sectional perspective view showing a state before the waterproof connector shown in FIG. 1 is assembled, FIG. 3 is a sectional view showing a state in which the waterproof connector shown in FIG. 1 has been assembled, and FIG. 4 is a rear elevation view of the waterproof connector shown in FIG. 1.

As shown in FIGS. 1 to 4, a housing 11 of a waterproof connector 10 includes an inner housing 12 made of synthetic resin, an outer housing 17 made of synthetic resin, and a spacer 28 made of synthetic resin disposed between the inner housing 12 and the outer housing 17.

The inner housing 12 is integrally formed with a plurality of terminal accommodation chambers 13. The inner housing 12 is fitted into the outer housing 17. The spacer 28 holds a female terminal 14 accommodated in each of the terminal accommodation chambers 13 of the inner housing 12.

As shown in FIGS. 1 and 2, the inner housing 12 includes a box portion 12*a* opened at its one end side upper and lower surfaces, a central horizontal wall 12*b*, and upper and lower vertical side walls 12*c* also functioning as partition walls. The terminal accommodation chamber 13 is defined by the horizontal wall 12*b* and the vertical side walls 12*c*. A terminal 14 is accommodated in the terminal accommodation chamber 13. Engaging pawls (third engaging portions) 15 project from opposite ends and center of the upper and lower surfaces of the box portion 12*a*. A flange portion 16 projects from the other end of the box portion 12*a*. The box portion 12*a* is formed at its other end wall with rectangular insertion holes 12*d* which are in communication with the terminal accommodation chamber 13. Male terminals in the partner connector (not shown) freely pass through the insertion hole 12*d*. Each of the terminals 14 is formed at its one end with a pair of press-contact blades 14*b* and 14*b*.

As shown in FIGS. 1 to 3, the outer housing 17 is formed into a double box-like shape having a substantially quadratic prism like inner wall 17*a* and a substantially quadratic prism like outer wall 17*b* covering the inner wall 17*a*. One end of the outer housing 17 is occluded by a bottom wall (first wall) 17*c* connecting the inner and outer walls 17*a* and 17*b*. The other end of the outer housing 17 is opened. The bottom wall 17*c* is formed at its central portion with a thick portion extending outward. Rubber plug accommodation recesses 19 each having a circular cross section opening toward inside (first accommodation recess) of the outer housing 17 are formed in the other end of the thick portion. Each of the rubber plug accommodation recesses 19 is formed such as to oppose to each of the terminal accommodation chambers 13. Waterproof rubber plugs 18 are accommodated in the rubber accommodation recesses 19 by press fit or the like. The thick portion is formed at its one end with first insertion holes 21 each having circular cross section for bringing each of the rubber plug accommodation recesses 19 and the outside into communication with each other. The first insertion hole 21 has the diameter smaller than that of the rubber plug accommodation recess 19. The waterproof rubber plug 18 is formed into a substantially cylindrical shape having uneven inner and outer surfaces, and an electric wire 20 passes through the waterproof rubber plug 18 without clearance.

The other end side upper and lower walls of the inner wall 17*a* of the outer housing 17 are formed with rectangular engaging holes (first engaging portions) 22 and 23 with which engaging pawls 15 of the inner housing 12 are engaged. V-shaped packing receiving portions 25 for receiving annular rubber waterproof packings 24 integrally project from an outer surface side one end of the inner wall 17*a*. An inner surface side other end of the inner wall 17*a* is formed with tapered surfaces 26 inclining toward the engaging holes 22 and 23. The other end side upper and lower walls of the outer wall 17*b* are formed with engaging holes 27 engaging plastic engaging arms of the partner connector (not shown).

As shown in FIGS. 1 to 3, the spacer 28 includes a substantially quadratic prism like body portion 28*a*, a substantially quadratic prism like flange portion 28b turned up from the other end of the body portion 28*a* toward the one end thereof, and a bottom wall (second wall) 28*c* occluding the one end of the body portion 28*a*. The spacer is formed into a box-like shape whose one end is opened. The body portion 28*a* is fitted to the inner surface side of the inner wall 17*a* of the outer housing 17. The flange portion 28*b* is fitted to the outer surface side of the inner wall 17*a* of the outer housing 17.

The box portion 12*a* of the inner housing 12 is fitted into the body portion 28*a* of the spacer 28. Rib-like projections 29 for preventing the terminals from coming off project from the inner surface of the upper and lower walls of the body portion 28*a*. Each of the projections 29 engages one end edge of the box portion 12*a* of the inner housing 12 and one end edge of the terminal 14 accommodated in each of the terminal accommodation chambers 13.

Notches 30 and 31 are formed at the connected portion between the body portion 28*a* and the flange portion 28*b* of the spacer 28. The notches 30 are opposed to the engaging pawls 15 of the inner housing 12, and the notch 31 is opposed to the flange portion 16. Engaging pawls (second engaging portions) 32 project from the outer surface side upper and lower walls of the body portion 28*a* of the outer housing 17. The engaging pawls 32 are disposed between the upper and lower notches 30 and 30 and engaged with the engaging holes 23 of the outer housing 17. When the spacer 28 is completely fitted into the outer housing 17, the packings 24 are held between the one end of the flange portion 28*b* of the spacer 28 and the packing receiving portions 25 of the outer housing.

The bottom wall 28*c* of the spacer 28 is formed with insertion holes 33 disposed such as to oppose to the insertion holes 21 of the outer housing 17. When the spacer 28 is completely fitted into the outer housing 17, the rubber plugs 18 inserted in the rubber plug accommodation recesses 19 are prevented from coming off by the bottom wall 28*c* of the spacer 28. As shown in FIG. 1, each of the electric wires 20 passing through each of the insertion holes 21 of the outer housing 17, each of the rubber plugs 18 and each of the insertion holes 33 of the spacer 28 are connected by pressure welding between the pair of press-contact blades 14*b* and 14*b* of each of the terminals 14 in the terminal accommodation chamber 13 of the inner housing 12. Each of the terminal accommodation chambers 13 and each of the electric wires 20 are sealed by the rubber plug 18 and the packing 24.

When the waterproof connector 10 of the embodiment is assembled, as shown in FIG. 7, the rubber plugs 18 are first inserted into the rubber plug accommodation recesses 19 of the outer housing along a first direction (in a direction in which the inner housing 11 is fitted into the outer housing 17). The packings 24 are inserted into the packing receiving portions 25 of the outer housing 17.

Figure 7A:
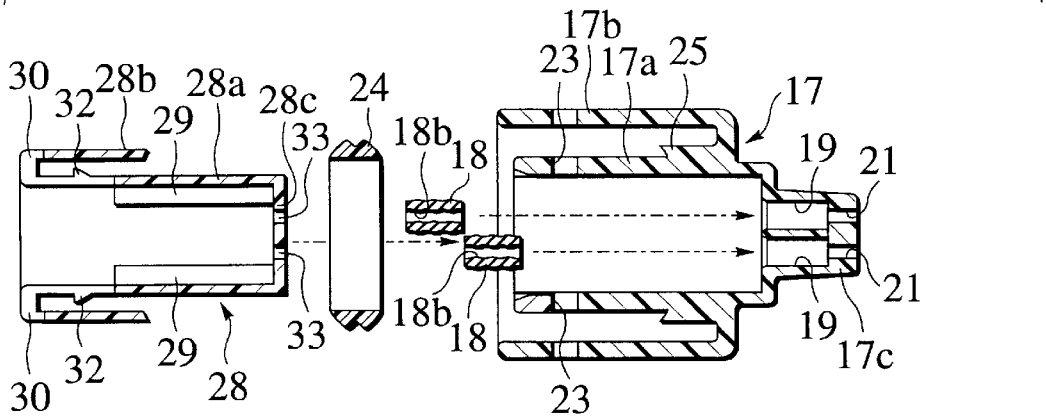
FIG. 7A is a sectional view showing a state before the waterproof connector shown in FIG. 1 is assembled.
Figure 7B:
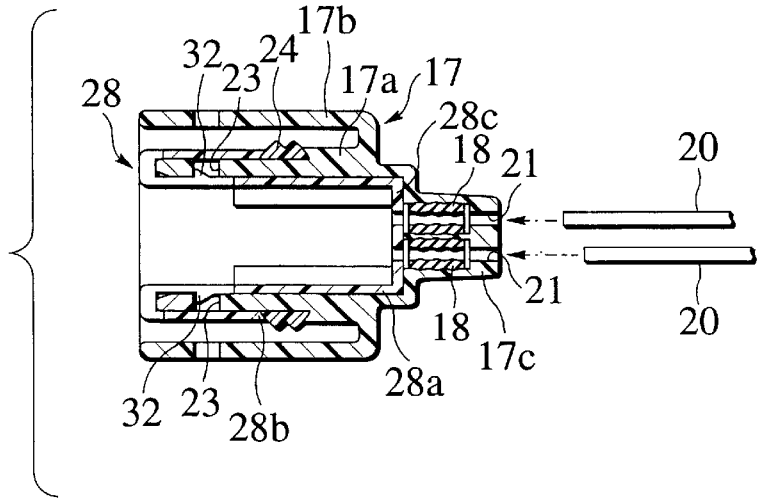
FIG. 7B is a sectional view showing a state in which a spacer is fitted to an outer housing shown in FIG. 7A.

Next, as shown in FIG. 7B, the body portion 28*a* of the spacer 28 is fitted to the inner wall 17*a* of the outer housing 17, and the engaging pawls 32 of the spacer 28 are engaged with the engaging holes 23 of the outer housing 17. The spacer 28 is fixed to the outer housing 17 by the engagement between the engaging holes 23 and the engaging pawls 32. In this state, the rubber plugs 18 are prevented from coming off by the bottom wall 17*c* of the outer housing 17, and the packings 24 are prevented from coming off by the inclined tip end of the flange portion 28*b* of the spacer 28. Accordingly, waterproof properties of the whole housing are improved.

Figure 7C:
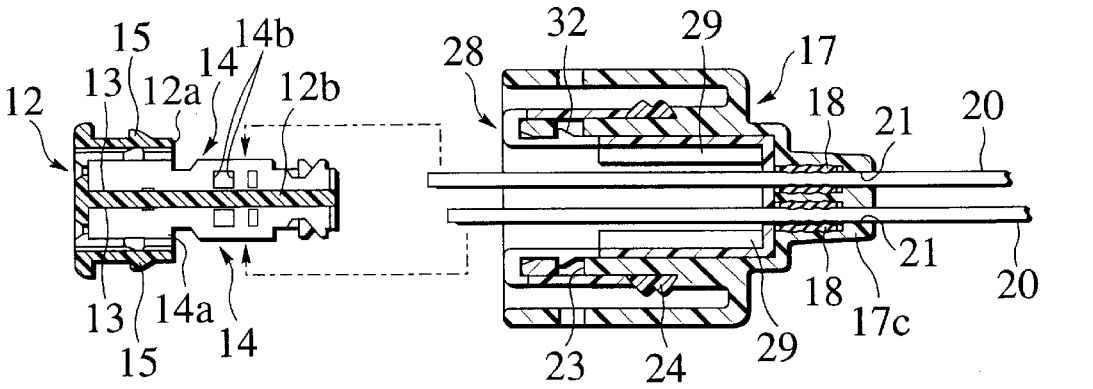
FIG. 7C is a sectional view showing a state in which electric wires are inserted through the outer housing and the spacer shown in FIG. 7B.
Figure 7D:
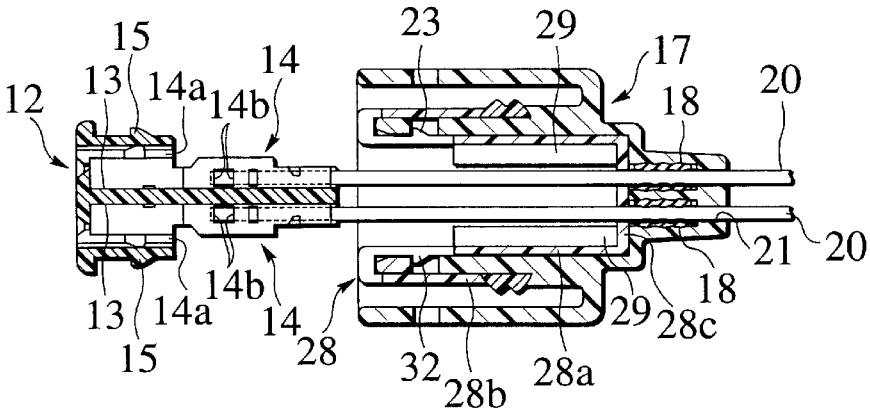
FIG. 7D is a sectional view showing a state in which the electric wires shown in FIG. 7C are connected to terminals in terminal accommodation chambers of an inner housing.

Then, as shown in FIG. 7C, the electricwires 20 are inserted through the insertion holes 21 of the outer housing 17, the rubber plugs 18 and the insertion holes 33 of the spacer 28 from the outer side sequentially. Next, as shown in FIG. 7D, the electric wires 20 are connected by pressure welding with the pair of presscontact blades 14*b* and 14*b* of the terminal 14 accommodated in each of the terminal accommodation chambers 13.

Figure 7E:
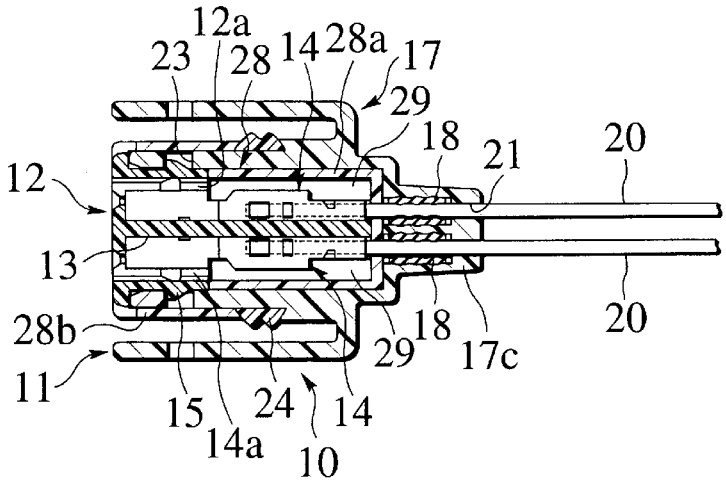
FIG. 7E is a sectional view showing a state in which the waterproof connector shown in FIG. 7D has been assembled.
Figure 8:
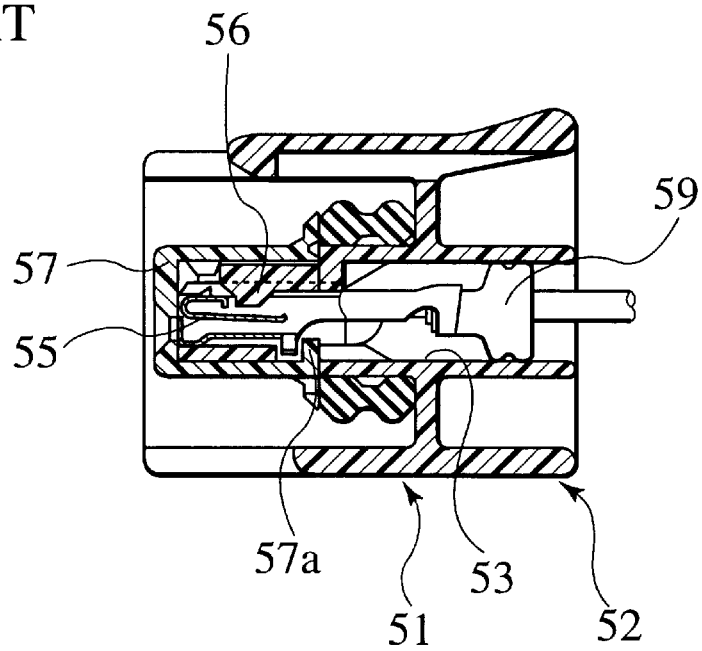
FIG.8 PRIOR ART
FIG. 8 is a sectional view of a conventional waterproof connector.
Figure 9:
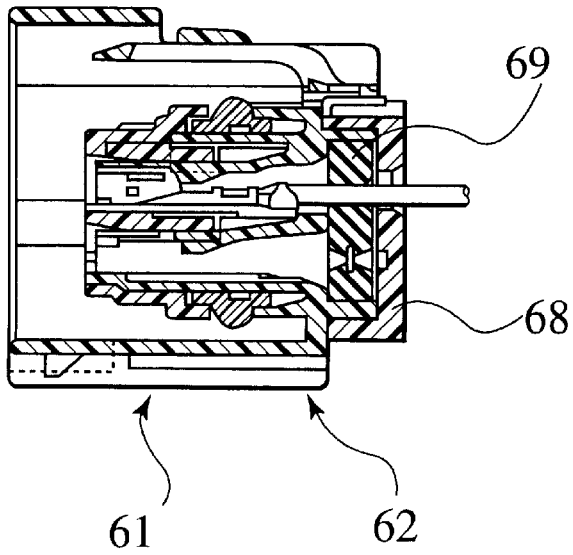
FIG.9 PRIOR ART
FIG. 9 is a sectional view of another conventional waterproof connector.
Figure 10:
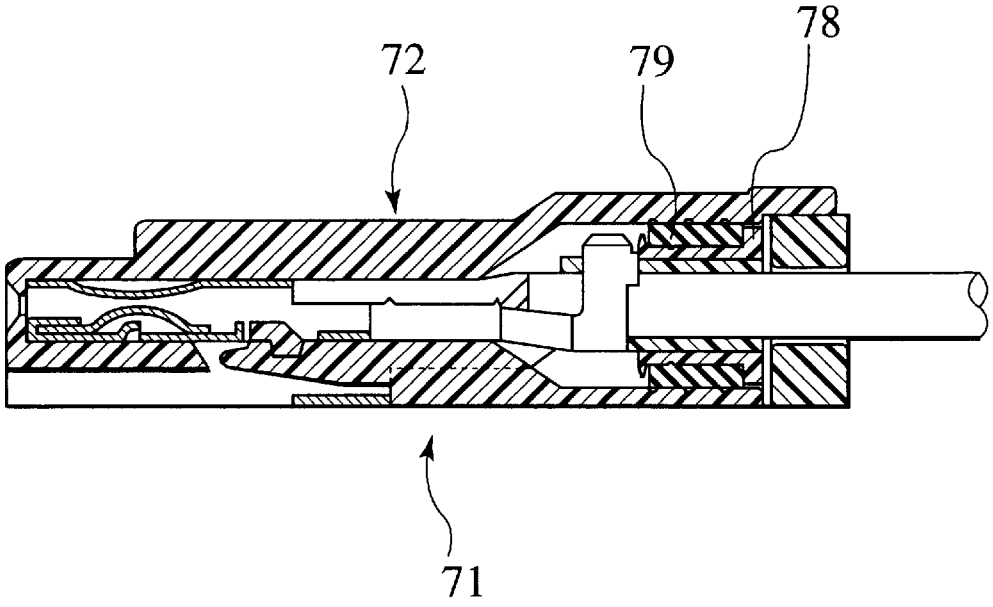
FIG.10 PRIOR ART
FIG. 10 is a sectional view of another conventional waterproof connector.

Then, as shown in FIG. 7E, the inner housing 12 is fitted into the body portion 28*a* of the spacer 28, and the engaging pawls 15 of the inner housing 12 are engaged with the engaging holes 23 of the outer housing 17. With this operation, the inner housing 12 is fixed to the outer housing 17, and the assembly of the waterproof connector 10 is completed. At that time, the projections of the spacer 28 lock one end edge of the box portion 12*a* of the inner housing 12 and one end edge of the box portion 14*a* of the female terminal 14 accommodated in each of the terminal accommodation chambers 13. Further, the projections 29 should not be deformed outward. Therefore, the terminal 14 is reliably prevented from coming off from the terminal accommodation chamber 13. Furthermore, since both the terminal 14 and the rubber plug 18 are held by the spacer 28 at the same time, a part used only for preventing the rubber plug 18 from coming off is unnecessary. Therefore, the number of constituent parts is reduced, and the cost is reduced. Further, the spacer 28 is double-locked by the engagement between the engaging pawls 32 of the spacer 28 itself and the engaging holes 23 of the outer housing 17, and by the engagement between the engaging pawls 15 of the inner housing 12 and the engaging holes 23 of the outer housing 17. Therefore, the rubber plug 18 and the packing 24 are reliably prevented from coming off and thus, the waterproof reliability is further enhanced.

As described above, since the terminals are reliably held by the spacer 28 between the inner housing 12 and the outer housing 17, the holding force of the terminal 14 is increased, and the reliability is enhanced. Therefore, a small size multipolar waterproof connector having excellent holding strength of the terminals and excellent waterproof properties can be assembled easily, smoothly and at low cost in a short time. After the assembly of the waterproof connector 10 is completed, when the electric wires 20 are pulled for example, since the terminals 14 are prevented from moving by the spacer 28, the terminals 14 are reliably held in the terminal accommodation chambers 13.

Further, as shown in FIG. 3, the diameter L of the rubber plug accommodation recess 19 of the outer housing 17 can be made as small as possible without being influenced by the size of the terminal accommodation chamber 13 of the inner housing 12. Therefore, as compared with the conventional structure, the pitch X between the terminals shown in FIG. 4 can be made small, and the multipolar housing 11 can be reduced in size. Further, as shown in FIG. 3, the rubber plug 18 is completely surrounded by the rubber plug accommodation recess 19 of the outer housing 17 and is not exposed outside from the bottom wall 17*c*. Therefore, deterioration of the sealing performance of the rubber plug 18 due to the external force is reliably prevented, and the waterproof reliability of the entire waterproof connector 10 is further enhanced.

Although the present embodiment has been explained based on the case in which the electric wires are connected by pressure welding with the pressure terminals, the terminal is not limited to the pressure welded terminal, and the present embodiment can also be applied to a case in which the electric wires are connected by pressure welding with the pressure terminals.

What is claimed is:

1. A waterproof connector comprising:

an inner housing having a plurality of terminal accommodation chambers in each of which a terminal is accommodated;

an outer housing into which the inner housing is fitted, the outer housing including a first wall opposed to the terminal accommodation chambers, the first wall including rubber plug accommodation recesses opening toward inside of the outer housing and first insertion holes bringing the rubber plug accommodation recesses and the outside of the outer housing into communication with each other;

rubber plugs to be inserted into the rubber plug accommodation recesses, each of the rubber plugs including a third insertion hole;

a spacer disposed between the inner housing and the outer housing and holding the terminals accommodated in the terminal accommodation chambers, the spacer including a second wall between the terminal accommodation chambers and the first wall, the second wall including second insertion holes; wherein the terminals in the terminal accommodation chambers are connected to electric wires, each of the electric wires being inserted through the first, third and second insertion holes; and the terminal accommodation chambers and the electric wires are sealed by the rubber plugs.

2. A waterproof connector according to claim 1, wherein the spacer includes a projection for holding the terminals in the terminal accommodation chambers of the inner housing, and the second wall of the spacer prevents the rubber plugs from coming off from the rubber plug accommodation recesses.

3. A waterproof connector according to claim 1, further comprising:

a first engaging portion provided on the outer housing;

a second engaging portion provided on the spacer and capable of engaging the first engaging portion; and a packing disposed between the outer housing and the spacer.

4. A waterproof connector according to claim 3, further comprising:

a third engaging portion disposed on the inner housing and capable of engaging the first engaging portion.

5. An assembling method of a waterproof connector including an inner housing, an outer housing, a spacer and a rubber plug, the method comprising the steps of:

inserting the rubber plug in a rubber plug accommodation recess of the outer housing along a first direction, the outer housing including a first wall having a rubber plug accommodation recess opening inside of the outer housing, and a first insertion hole bringing the rubber plug accommodation recess and the outside of the outer housing into communication with each other, and the rubber plug including a third insertion hole;

fitting the spacer into the inside of the outer housing along the first direction, the spacer including a second wall facing the first wall, the second wall including a second insertion hole;

inserting an electric wire through the first, second and third insertion holes;

connecting the electric wire to a terminal in a terminal accommodation chamber of the inner housing; and fitting the inner housing into the spacer along the first direction, the terminal accommodation chamber and the electric wire being sealed by the rubber plug.

6. A waterproof connector comprising;

an outer housing including a first accommodation recess having a first opening and a first wall defining the first accommodation recess and opposed to the first opening, the first wall having a rubber plug accommodation recess opening toward the first accommodation recess, and a first insertion hole bringing the outside of the outer housing and the rubber plug recess into communication with each other;

a rubber plug to be inserted into the rubber plug accommodation recess, the rubber plug including a third insertion hole;

a spacer fitted into the first accommodation recess from the first opening, the spacer including a second accommodation recess having a second opening and a second wall defining the second accommodation recess and facing the first wall, and the second wall including a second insertion hole; and an inner housing fitted into the second accommodation recess from the second opening, the inner housing including a terminal accommodation chamber into which a terminal is accommodated, the terminal in the terminal accommodation chamber being held by the space and connected to an electric wire passing through the first, third and second insertion holes, and the terminal accommodation chamber and the electric wire being sealed by the rubber plug.

7. A waterproof connector according to claim 6, wherein the spacer includes a projection holding the terminal in the terminal accommodation chamber of the inner housing, and the second wall of the spacer prevents the rubber plug from coming off from the rubber plug accommodation recess.

8. A waterproof connector according to claim 6, further comprising:

a first engaging portion provided on the outer housing;

a second engaging portion provided on the spacer, and capable of engaging the first engaging portion; and a packing disposed between the outer housing and the spacer.

9. A waterproof connector according to claim 8, further comprising:

a third engaging portion provided on the inner housing, and capable of engaging the first engaging portion.

* * * * *